US007152613B2

(12) United States Patent
Lee et al.

(10) Patent No.: US 7,152,613 B2
(45) Date of Patent: Dec. 26, 2006

(54) CLEANING APPARATUS HAVING FLUID MIXING NOZZLE FOR MANUFACTURING FLAT-PANEL DISPLAY

(75) Inventors: Sok-Joo Lee, Yongin (KR); Gi-Bum Park, Suwon (KR)

(73) Assignee: Display Manufacturing Service Co., Ltd., Kyungki-do (KR)

( * ) Notice: Subject to any disclaimer, the term of this patent is extended or adjusted under 35 U.S.C. 154(b) by 645 days.

(21) Appl. No.: 10/413,556

(22) Filed: Apr. 15, 2003

(65) Prior Publication Data

US 2003/0196689 A1 Oct. 23, 2003

(30) Foreign Application Priority Data

Apr. 19, 2002 (KR) ..... 10-2002-0021553

(51) Int. Cl.
*B08B 3/00* (2006.01)

(52) U.S. Cl. ..... 134/102.2

(58) Field of Classification Search ..... 134/102.2, 134/100.1, 102.1
See application file for complete search history.

(56) References Cited

U.S. PATENT DOCUMENTS 4,787,404 A * 11/1988 Klosterman et al. ..... 134/198
5,730,806 A * 3/1998 Caimi et al. ..... 134/22.12
6,375,088 B1 * 4/2002 Warrick ..... 239/1

* cited by examiner

*Primary Examiner*—Joseph L. Perrin
(74) *Attorney, Agent, or Firm*—Rothwell, Figg, Ernst & Manbeck

(57) ABSTRACT

Provided is a cleaning apparatus having a fluid mixing nozzle, the cleaning apparatus having a fluid mixing nozzle, the cleaning apparatus for cleaning a glass plate used in the manufacture of a flat-panel display and which mixes a cleaning fluid with a gas and sprays the mixture uniformly on the entire surface of a glass plate, thereby providing superior cleaning effects with a minimum amount of cleaning fluid. The fluid mixing nozzle includes a nozzle in the shape of a rectangle, which mixes a cleaning fluid and a pressured gas and sprays a mixture on the flat-panel display. By tightening the nozzle in a direction of the short axis of the nozzle with use of streamlined structures at a predetermined interval, it is possible to prevent a gap of the nozzle from being elastically deformed. Even with a small amount of cleaning fluid, it is possible for the mixture to be sprayed uniformly on the entire surface of the flat-panel display and for the cleaning effects of a glass plate used in manufacturing the flat-panel display to be improved.

8 Claims, 4 Drawing Sheets

CLEANING APPARATUS HAVING FLUID MIXING NOZZLE FOR MANUFACTURING FLAT-PANEL DISPLAY

CROSS REFERENCES TO RELATED APPLICATIONS

This application claims the priority of Korean Patent Application No. 2002-21553, filed on Apr. 19, 2002, in the Korean Intellectual Property Office, the contents of which are hereby incorporated by reference in their entirety as if fully set forth herein.

BACKGROUND OF THE INVENTION

1. Field of the Invention

The present invention relates to a cleaning apparatus of a flat-panel display, and more particularly, to a cleaning apparatus having a fluid mixing nozzle for manufacturing a flat-panel display.

2. Description of the Related Art

As the integration of flat-panel displays such as a liquid crystal display (LCD) increases, it becomes more important to remove contaminants or environmental pollution generated during manufacturing of the flat-panel displays in order to maintain throughput and quality control. Thus, a glass plate used to manufacture the flat-panel display needs to be cleaned so that contaminants and particles on the glass plate can be removed. In general, the glass plate is cleaned with a cleaning fluid such as deionized water, and thus organic or inorganic materials on the glass plate are removed or dissolved. Here, the cleaning fluid is sprayed onto the glass plate from a spray nozzle of a cleaning apparatus.

Such a cleaning apparatus and/or a spray nozzle should satisfy the following requirements.

Firstly, the cleaning apparatus and/or the spray nozzle should provide superior cleaning effects with a minimum amount of the cleaning fluid. Secondly, the cleaning apparatus and/or the spray nozzle should spray the cleaning fluid uniformly on the entire surface of the glass plate. Thirdly, the cleaning apparatus and/or the spray nozzle should consist of a small number of components so as to be easy to assemble and maintain.

In order to reduce the amount of cleaning fluid used, gases such as air can be mixed with the cleaning fluid. For example, a cleaning apparatus having a fluid mixing nozzle, as shown in FIG. 1, can be used to reduce the amount of cleaning fluid used.

As shown in FIG. 1, a general cleaning apparatus having a fluid mixing nozzle 10 consists of a nozzle body 20 in the shape of a cylinder, a fluid supply unit 30 which supplies a fluid such as a cleaning fluid to the nozzle body 20, and a gas supply unit 40 which supplies a gas to the nozzle body 20. The fluid and the gas respectively supplied to the nozzle body 20 by the fluid supply unit 30 and the gas supply unit 40 are mixed inside the nozzle body 20. The mixture is sprayed onto a glass plate 50 through a nozzle 25 at the end of the nozzle body 20.

FIG. 2 shows the spray area 55 of the mixture. As shown in FIG. 2, the spray area 55 of the mixture has an annular shape surrounding the nozzle 25. Thus, the cleaning apparatus having a fluid mixing nozzle 10 can spray the mixture onto only a restricted area surrounding the nozzle 25. In order to spray the mixture uniformly on the entire surface of the glass plate 50, it is necessary to arrange a plurality of fluid mixing nozzles 10 at right angles to the direction in which the glass plate 50 moves. However, this causes an increase in the number of whole components, and thus it becomes difficult to assemble and maintain the cleaning apparatus having many fluid mixing nozzles 10.

In addition, since the spray area 55 of the mixture has an annular shape, overlapped cleaning may occur with respect to the moving glass plate 50 or a space between the fluid mixing nozzles 10 adjacent to each other. Therefore, the amount of cleaning fluid used increases, and the mixture cannot be sprayed uniformly on the entire surface of the glass plate 50.

SUMMARY OF THE INVENTION

The present invention provides a cleaning apparatus having a fluid mixing nozzle, the cleaning apparatus for cleaning a glass plate used in the manufacture of a flat-panel display and which mixes a cleaning fluid with a gas and sprays the mixture uniformly on the entire surface of a glass plate, thereby providing superior cleaning effects with a minimum amount of cleaning fluid.

According to an aspect of the present invention, there is provided a cleaning apparatus having a fluid mixing nozzle, the cleaning apparatus comprising a body having a shape of a rectangle and includes a nozzle in the shape of a rectangle; a dividing wall which is disposed in the center of the body along a major axis of the body and divides the body into a cleaning fluid storage unit at atmospheric pressure and a pressured gas storage unit; a gas supply hole which is formed in an upper portion of the pressured gas storage unit at one side of the dividing wall; a laminar flow conversion means which is disposed in the pressured gas storage unit and changes the flow of a pressured gas supplied from the gas supply hole into laminar flow; a cleaning fluid supply hole which is disposed in an upper portion of the cleaning fluid storage unit at the other side of the dividing wall; a fluid mixing nozzle which is in the shape of ¬, mixes the cleaning fluid supplied through a horizontal channel under the cleaning fluid storage unit with the pressured gas supplied through a vertical channel under the pressured gas storage unit, and sprays a mixture on the flat-panel display through the nozzle; and structures which have a shape of streamline and tighten the nozzle in a direction of a short axis of the nozzle to prevent a gap of the nozzle from being elastically deformed.

The laminar flow conversion means is a perforated plate which divides the pressured gas storage unit into an upper storage unit and a lower storage unit. The fluid mixing nozzle is a veturi tube. The nozzle is built in one end of the fluid mixing nozzle in the shape of ¬.

It is preferable that the amount of cleaning fluid sprayed on the flat-panel display and the kinetic energy of the sprayed mixture are controlled by controlling the flow rate of the pressured gas.

The major axis of the cleaning apparatus is disposed at a right angle to the direction of the flat-panel display moved and more than two cleaning apparatuses can be equipped to the direction of the flat-panel display moved. Otherwise, they can be equipped on the both sides of the upper and lower flat-panel display.

According to the present invention, the amount of cleaning fluid sprayed is less than that of a conventional cleaning apparatus. Since the cleaning fluid is sprayed uniformly on the entire surface of the glass plate, the cleaning effects of the glass plate used in manufacturing of the flat-panel display can be improved. In addition, the cleaning apparatus of the present invention provides a fluid mixing nozzle in the shape of a rectangle instead of a plurality of fluid mixing nozzles of the conventional cleaning apparatus. Since the number of components of the cleaning apparatus is small, the cleaning apparatus can be easily assembled and maintained.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE EMBODIMENT

Figure 1:
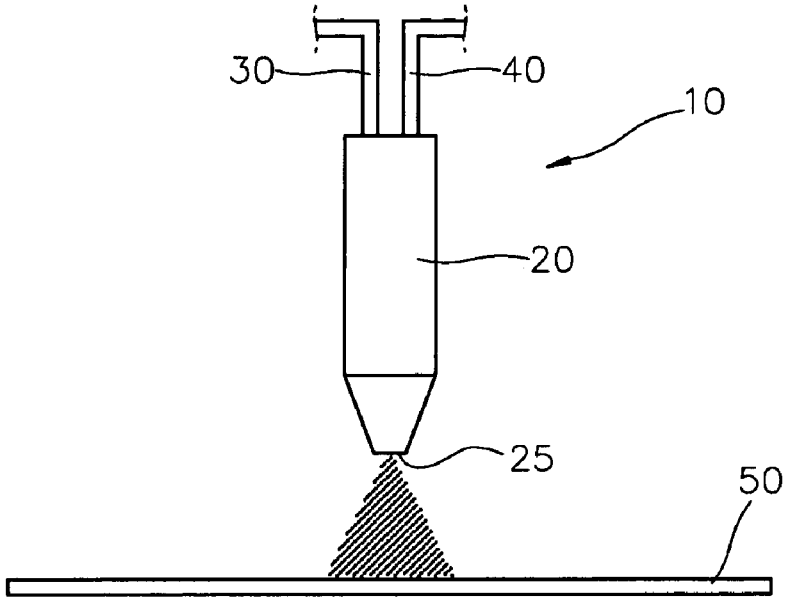
FIG. 1 (PRIOR ART)
FIG. 1 is a diagram of a general cleaning apparatus having a fluid mixing nozzle.
Figure 2:
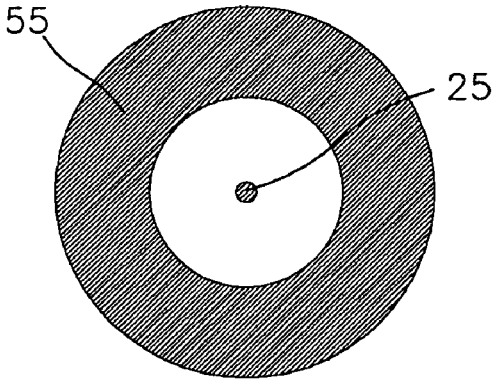
FIG. 2 (PRIOR ART)
FIG. 2 shows the spray area of a mixture sprayed from the general cleaning apparatus of FIG. 1.

The present invention now will be described more fully with reference to the accompanying drawings, in which preferred embodiments of the invention are shown. This invention may, however, be embodied in many different forms and should not be construed as being limited to the embodiments set for therein. Rather, these embodiments are provided so that this disclosure will be thorough and complete and will fully convey the scope of the invention to those skilled in the art. In the drawings, the forms of elements are exaggerated for clarity. To facilitate understanding, identical reference numerals have been used where possible to designate identical elements that are common to the figures.

Figure 3:
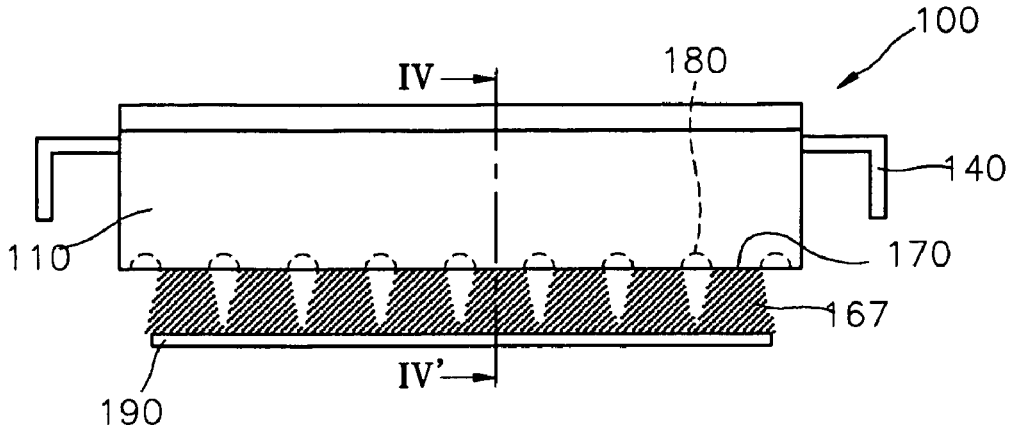
FIG. 3 is a diagram of a cleaning apparatus having a fluid mixing nozzle according to an embodiment of the present invention.

FIG. 3 is a diagram of a cleaning apparatus 100 having a fluid mixing nozzle according to an embodiment of the present invention. This diagram is taken in view of a direction in which a flat-panel display moves.

Referring to FIG. 3, the cleaning apparatus 100 having a fluid mixing nozzle according to an embodiment of the present invention includes a body 110 in the shape of a rectangle having a nozzle 170 in the shape of a rectangle. A mixture 167 of a cleaning fluid and a pressured gas is sprayed onto a flat-panel display 190 from the nozzle 170. Reference numeral 140 denotes an overflow pipe mounted in a cleaning fluid storage unit 130 of FIG. 4 and will be described later with reference to FIG. 4.

In order to prevent a gap of the nozzle 170 from being elastically deformed due to the pressure of the mixture 167 sprayed from the nozzle 170, streamlined structures 180 are formed at the end of the nozzle 170 at a predetermined interval. Holes are formed in the streamlined structures 180 and bolts are inserted into the holes to be tightened to nozzle 170 in the direction of the short axis of the nozzle 170. That is, the nozzle 170 comes to include rectangular cells separated at a predetermined interval by the streamlined structures 180. Since a force applied to the gap of the nozzle 170 due to the pressure of the mixture 167 is compensated for by a fixed bolt torque, it is possible to spray the mixture 167 on the glass plate 190 from the nozzle 170 without the occurrence of any elastic deformation. If the streamlined structures 180 are not formed, the gap of the nozzle 170 is elastically deformed by the force applied to the gap of the nozzle 170 due to the highly pressured mixture 167. Thus, the gap of the nozzle 170 becomes to have an oval shape, within a standard deviation of 10%. Therefore, the mixture 167 cannot be sprayed uniformly on the entire surface of the glass plate 190.

Figure 4:
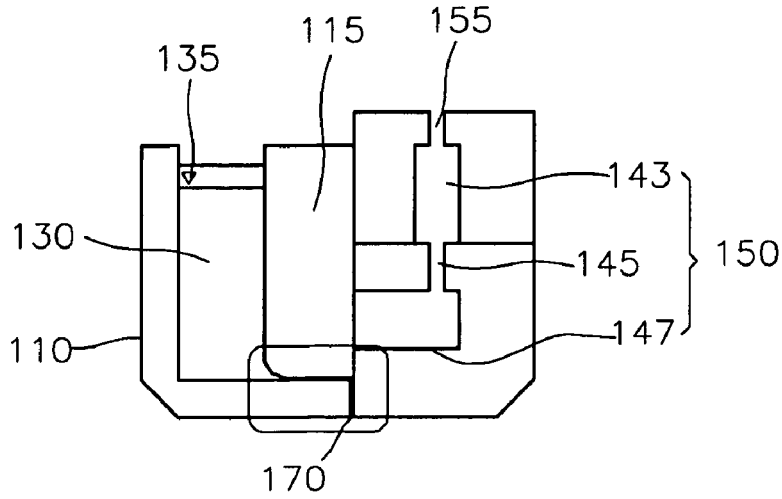
FIG. 4 is a sectional view taken along line IV–IV' of FIG. 3.
Figure 5:
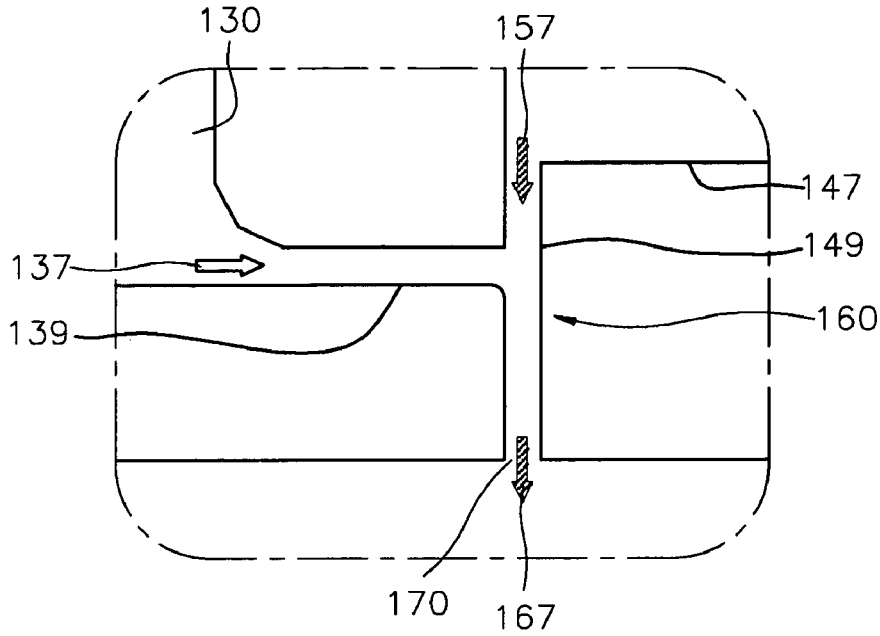
FIG. 5 is an enlarged view of a part of FIG. 4.

FIG. 4 is a sectional view taken along IV—IV' line of FIG. 3, and FIG. 5 is an enlarged view of a part of FIG. 4.

Referring to FIG. 4, a dividing wall 115 is equipped at the center of the body 110 along with a major axis of the body 110. The dividing wall 115 divides the body 110 into a cleaning fluid storage unit 130 at atmospheric pressure and a pressured gas storage unit 150.

A gas supply hole 155 is formed in an upper portion of the pressured gas storage unit 150 at one side of the dividing wall 115. The flow of the pressured gas supplied through the gas supply hole 155 becomes laminar flow after passing through a laminar flow conversion means 145 in the pressured gas storage unit 150. The laminar flow conversion means 145 divides the pressured gas storage unit 150 into an upper storage unit 143 and a lower storage unit 147. The pressured gas may be clean dry air (CDA).

A cleaning fluid supply hole 135 is formed in the upper portion of the cleaning fluid storage unit 130 at the other side of the dividing wall 115. If more than a predetermined amount of cleaning fluid is stored in the cleaning fluid storage unit 130, an overflow pipe 140 of FIG. 3 allows surplus cleaning fluid to drain so that the cleaning fluid supplied by the cleaning fluid supply hole 135 can be at atmospheric pressure.

Referring to FIGS. 4and 5, a fluid mixing nozzle 160 in the shape of ¬ is formed in a lower portion of the dividing wall 115. A cleaning fluid 137 and a pressured gas 157 are respectively supplied to the fluid mixing nozzle 160 through a horizontal channel 139 under the cleaning fluid storage unit 130 and a vertical channel 149 under the pressured gas storage unit 150, i.e., the lower storage unit 147. The cleaning fluid 137 and the pressured gas 157 are mixed and become the mixture 167. The mixture 167 is sprayed on the flat-panel display 190 of FIG. 3 through the nozzle 170. Here, it is preferable that the fluid mixing nozzle 160 is a venturi tube so as to cause a pressure difference between channels with respect to differences in the diameters of the channels. In addition, it is preferable that one end of the fluid mixing nozzle 160 is built in the nozzle 170.

Figure 6:
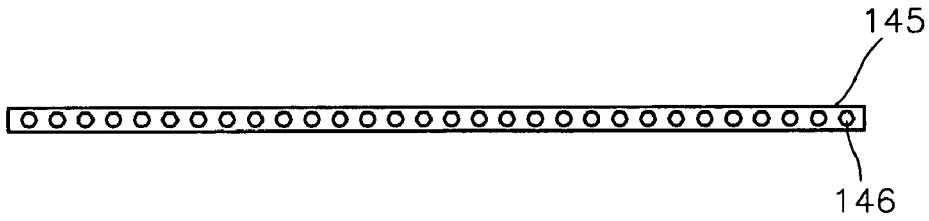
FIG. 6 is a top view of a perforated plate which may be included in the cleaning apparatus of FIG. 3.

FIG. 6 is a top view of a perforated plate which may be used as the laminar flow conversion means 145. For example, the flow of the pressured gas 157 supplied by the gas supply hole 155 becomes laminar flow after the pressured gas 157 is passed through holes 146 of the perforated plate 145.

Hereinafter, operations of the cleaning apparatus having a fluid mixing nozzle will be described in more detail. The inflow gas 157 supplied from the gas supply hole 155 is firstly converted into turbulent flow, and the pressured gas is stored in the upper storage unit 143. The pressured gas 157 stored in the upper storage unit 143 is converted into laminar flow under the influence of a pressure difference between channels due to differences in the diameters of the channels, after the pressured gas 157 is passed through the holes 146 of the perforated plate 145. Since the pressured gas is uniformly compressed after going through the holes 146 of the perforated plate 145, its flow is converted into the laminar flow at a uniform pressure after going through the holes 146. Since the cross section of the pressured gas that is converted into the laminar flow is rapidly expanded in the lower storage unit 147, its flow rate is lowered. As pressure energy rapidly increases due to a decrease in speed energy, the pressured gas 157 flows according to laminar flow at a high pressure. Then, the pressured gas 157 flowing according to laminar flow is supplied to the fluid mixing nozzle 160 and generates a vacuum pressure after going through the fluid mixing nozzle 160 in the shape of a venturi tube.

In addition, the cleaning fluid storage unit 130 maintains a predetermined level of head pressure by draining surplus cleaning fluid through the overflow pipe 140 if more than a predetermined amount of cleaning fluid is stored in the cleaning fluid storage unit 130. The cleaning fluid 137 is supplied through the horizontal channel under the cleaning fluid storage unit 130. Then, the cleaning fluid 137 and the pressured gas 157 are mixed, and the mixture 167 is sprayed taking advantage of the vacuum pressure generated after the pressured gas 157 goes through the fluid mixing nozzle 160. Thus, cleaning effects can be maximized with use of a minimum amount of the cleaning fluid. The amount of cleaning fluid sprayed to the flat-panel display 190 and the kinetic energy of the mixture 167 can be controlled by controlling the flow rate of the pressured gas 157. Also, the shape of the spray of the mixture 167 can vary with respect to the kinetic energy of the mixture 167.

Figure 7:
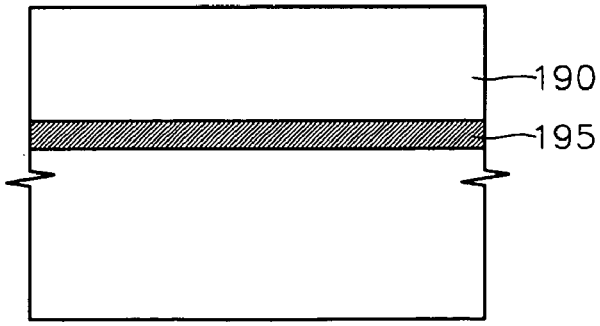
FIG. 7 shows the spray area of the mixture sprayed from the cleaning apparatus of FIG. 3.

FIG. 7 shows the spray area 195 of a mixture sprayed from a cleaning apparatus having a fluid mixing nozzle. As shown in FIG. 7, the spray area 195 of the mixture is formed in the shape of a rectangle on the surface of the flat-panel display 190 by way of streamlined structures 180 formed at a predetermined interval at the end of the nozzle 170 so as to prevent a gap of the nozzle 170 from being elastically deformed due to the pressure of the mixture 167 being sprayed from the nozzle 170. Here, the mixture 167 begins to be separated when it goes through the streamlined structures 180, and thus a turbulence is formed in a lower portion of the mixture 167. The size and placement interval of the streamlined structures 180 are important factors of a distance from which the turbulence is removed. That is, since the mixture 167 is uniformly sprayed from the nozzle 170 and bolt torque is uniformly maintained by including rectangular cells at a predetermined interval in the nozzle 170 with use of the streamlined structures 180, it is possible to spray the mixture 167 uniformly on the entire surface of the glass plate without the occurrence of elastic deformation of the nozzle 170 even though the length of the nozzle 170 is maximized. In addition, since the cleaning area is not overlapped, it is possible to reduce consumption of the cleaning fluid.

Figure 8:
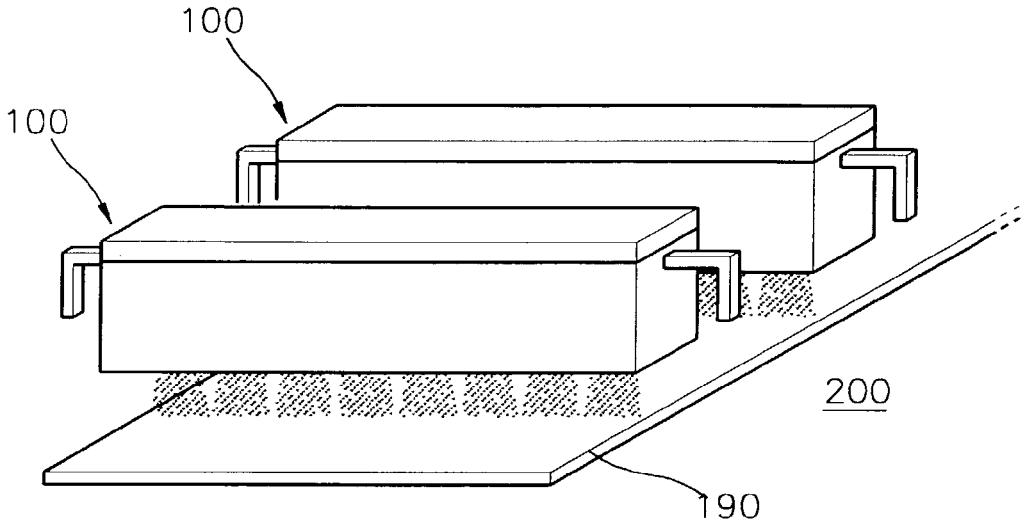
FIG. 8 is a perspective view of a cleaning apparatus having a fluid mixing nozzle according to another embodiment of the present invention.

FIG. 8 shows a cleaning apparatus having a fluid mixing nozzle according to another embodiment of the present invention. In the cleaning apparatus having the fluid mixing nozzle, the major axis of the cleaning apparatus having the fluid mixing nozzle of FIG. 3 is at a right angle to the direction of the flat-panel display 190, and two cleaning apparatuses are successively disposed. Here, the successive number of cleaning apparatuses may be more than 2. Thus, it is possible to improve the cleaning effects and to clean a large-area glass plate.

Figure 9:
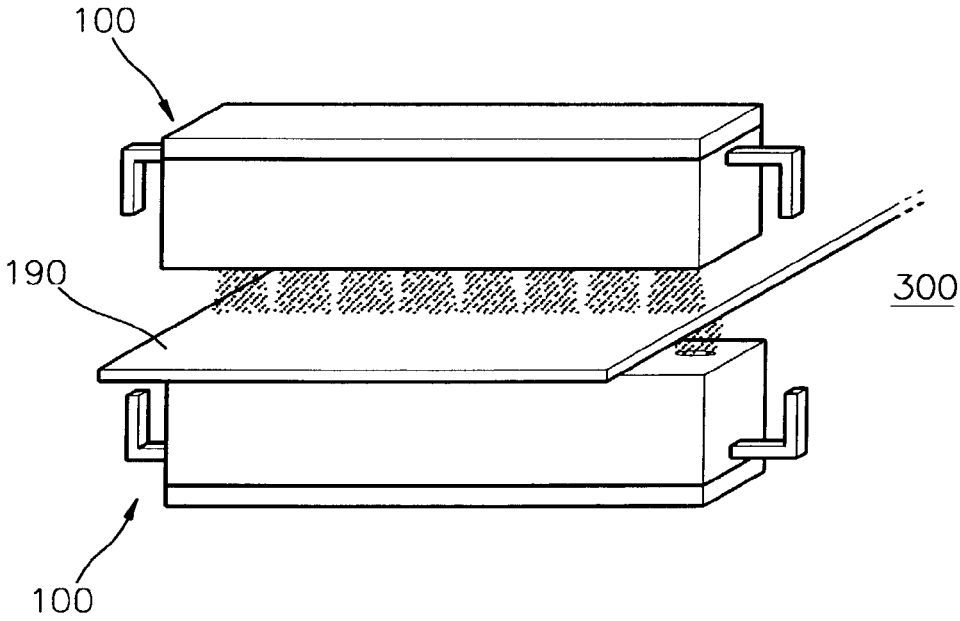
FIG. 9 is a perspective diagram of a cleaning apparatus having a fluid mixing nozzle according to yet another embodiment of the present invention.

FIG. 9 shows a cleaning apparatus having a fluid mixing nozzle according to still another embodiment of the present invention. In the cleaning apparatus having the fluid mixing nozzle, the major axis of the cleaning apparatus having the fluid mixing nozzle of FIG. 3 is at a right angle to the direction of the flat-panel display 190, and an upper portion and a lower portion of the cleaning apparatus having a fluid mixing nozzle are symmetrical to each other. Thus, both sides of the flat-plate display 190 can be simultaneously cleaned.

According to the present invention, since a mixture generated by mixing a cleaning fluid and a gas is used, it is possible to improve cleaning effects while using a minimum amount of the cleaning fluid. Since different substances having different characteristics are mixed, it is possible to take advantages of two different substances. By including a converting means which changes the flow of a gas supplied to an upper portion of a body into laminar flow and prevents a gap of a nozzle from being elastically deformed, it is possible to effectively mix a cleaning fluid with a gas and to maintain a predetermined sprayed shape. Therefore, a cleaning apparatus having a fluid mixing nozzle can be provided, which uses a small amount of a cleaning fluid and sprays a mixture of the cleaning fluid and the gas uniformly on the entire surface of a flat-panel display.

In addition, the cleaning apparatus of the present invention provides a fluid mixing nozzle in the shape of a rectangle instead of the plurality of fluid mixing nozzles of the conventional cleaning apparatus. Since the number of components of the cleaning apparatus is decreased, the cleaning apparatus can be easily assembled and maintained.

By using a successive number of cleaning apparatuses having a fluid mixing nozzle, it is possible to improve the cleaning effects and to clean a large-area glass plate.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A cleaning apparatus having a fluid mixing nozzle, the cleaning apparatus comprising:

a body, in the shape of a rectangle, including a nozzle having an opening in the shape of a rectangle;

a dividing wall which is disposed in the center of the body along a major axis of the body and divides the body into a cleaning fluid storage unit at atmospheric pressure and a pressured gas storage unit;

a gas supply hole which is formed in an upper portion of the pressured gas storage unit at one side of the dividing wall;

a laminar flow conversion means, disposed in the pressured gas storage unit, for changing the flow of a pressured gas, supplied from the gas supply hole, into laminar flow;

a cleaning fluid supply hold which is disposed in an upper portion of the cleaning fluid storage unit at the other side of the dividing wall;

a fluid mixing nozzle which is in the shape of ¬, mixes the cleaning fluid supplied through a horizontal channel under the cleaning fluid storage unit with the pressured gas supplied through a vertical channel under the pressured gas storage unit, and sprays a mixture on the flat-panel display through the nozzle; and structures tightening the nozzle, in a direction of a short axis of the nozzle, to prevent the opening of the nozzle from being elastically deformed.

2. The cleaning apparatus of claim 1, wherein the laminar flow conversion means is a perforated plate which divides the pressured gas storage unit into an upper storage unit and a lower storage unit.

3. The cleaning apparatus of claim 1, wherein the fluid mixing nozzle is a veturi tube.

4. The cleaning apparatus of claim 1, wherein the amount of cleaning fluid sprayed on the flat-panel display and the kinetic energy of the mixture are controlled by controlling the flow rate of the pressured gas.

5. The cleaning apparatus of claim 1, wherein the nozzle is built in one end of the fluid mixing nozzle in the shape of ⊣.

6. The cleaning apparatus of claim 1, wherein the major axis of the cleaning apparatus is disposed at a right angle to the direction the flat-panel display is moved and more than two cleaning apparatuses are successively disposed at a right angle to the direction the flat-panel display is moved.

7. The cleaning apparatus of claim 1, wherein the major axis of the cleaning apparatus is disposed at a right angle to the direction the flat-panel display is moved, and an upper portion and a lower portion of the cleaning apparatus are mounted in pairs such that a glass plate is placed between the upper portion and the lower portion of the cleaning apparatus, and the upper portion and the lower portion of the cleaning apparatus are vertically symmetrical with each other.

8. The cleaning apparatus of claim 1, wherein the structures tightening the nozzle are formed at a predetermined interval and include a plurality of bolts inserted into a plurality of holes.

* * * * *